US006535709B2

(12) United States Patent
Yokomori et al.

(10) Patent No.: US 6,535,709 B2
(45) Date of Patent: Mar. 18, 2003

(54) DEVELOPING APPARATUS FEATURING AN END OF A REGULATING MEMBER COUPLED TO A SUPPORTING MEMBER OF THE APPARATUS, REGULATING MEMBER, AND METHOD FOR ASSEMBLING THE SAME

(75) Inventors: Kanji Yokomori, Odawara (JP); Takeshi Arimitsu, Odawara (JP); Susumu Nittani, Sunto-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/828,145

(22) Filed: Apr. 9, 2001

(65) Prior Publication Data

US 2001/0031158 A1 Oct. 18, 2001

(30) Foreign Application Priority Data

Apr. 13, 2000 (JP) ..... 2000-111585

(51) Int. Cl.[7] ..... G03G 15/08
(52) U.S. Cl. ..... 399/274; 399/284
(58) Field of Search ..... 399/274, 284

(56) References Cited

U.S. PATENT DOCUMENTS

| | | | | |
|---|---|---|---|---|
| 6,029,027 | A | 2/2000 | Yokomori et al. | 399/90 |
| 6,032,002 | A | 2/2000 | Yokomori et al. | 399/12 |
| 6,047,150 | A | 4/2000 | Kanno et al. | 399/119 |
| 6,104,895 | A | 8/2000 | Yokomori et al. | 399/113 |
| 6,175,708 | B1 * | 1/2001 | Ohashi et al. | 399/274 |

* cited by examiner

*Primary Examiner*—William J. Royer
(74) *Attorney, Agent, or Firm*—Fitzpatrick, Cella, Harper & Scinto

(57) ABSTRACT

A developing apparatus and a method for assembling the apparatus is capable of uniformalizing a thickness of a developer carried on a developer carrying body, thereby preventing a nonuniform optical density of an image from being produced. The developing apparatus includes a developing frame, a developer carrying body, and a regulating member, wherein the regulating member includes an elastic blade to be brought into contact with the developer and a supporting member for supporting the elastic blade. The supporting member is supported by the developing frame. The elastic blade is coupled with the supporting member by welding.

13 Claims, 11 Drawing Sheets

DEVELOPING APPARATUS FEATURING AN END OF A REGULATING MEMBER COUPLED TO A SUPPORTING MEMBER OF THE APPARATUS, REGULATING MEMBER, AND METHOD FOR ASSEMBLING THE SAME

BACKGROUND OF THE INVENTION

1. Field of the Invention

The present invention relates to developing apparatus preferably used in image forming apparatuses such as electrophotograph copying machines and electrophotograph printers, and an assembling method of the developing apparatus. The developing apparatus can be disposed in a cartridge which is detachably attachable to a main body of an image forming apparatus.

2. Related Background Art

It has conventionally been proposed an image forming apparatus for forming a multicolor image by electrophotography which has a configuration for a method capable of forming a multicolor image by disposing a plurality of developing cartridges containing developers (toners) of different colors on a rotating selection mechanism (developing rotary) for a photosensitive drum which is an electrophotographic photosensitive body, arranging a developing cartridge containing a developer of a predetermined color in opposition to the above described photosensitive drum, developing and visualizing a latent image into a developed image, transferring the developed image to a recording medium, and repeating developing and transferring operations for each color. There has been proposed also a method which configures the above described developing cartridge as a cartridge which is detachably attachable to a main body of an image forming apparatus so as to lessen a maintenance work of a user.

Such a developing cartridge is composed by combining a developing roller which is a developer carrying body, a developing blade which is a developer regulating member for regulating a thickness of a toner to be coated over the above described developing roller, a developing frame (developing member supporting frame) which supports a developing member such as a coating roller for coating the developing roller with the toner and a toner frame which contains the toner. This kind of developing cartridge is generally configured to enhance straightness and flatness of a support plate of the above described developing blade so that the developing blade is kept in uniform contact with the developing roller.

Furthermore, it is customary to fix both ends of the developing blade with machine screws so that the developing blade will not move relative to a developer container.

There have been proposed a process cartridge in which the above described developing cartridge is built as developing means and an image forming apparatus which comprises the process cartridge.

Conventionally, it is technically difficult to uniformalize a pressure of a developing blade applied to a developing roller in a longitudinal direction so as to uniformalize a layer thickness of a developer on the developing roller and it is desired to improve a technique for uniformalizing a pressure.

Though it is known to interpose an elastic blade between a support plate and a clamp plate, it is desired to omit the clamp plate to reduce a number of parts.

SUMMARY OF THE INVENTION

An object of the present invention relates to a developing apparatus and an assembling method for this apparatus which are capable of uniformalizing a thickness of a developer carried on a developer carrying body, thereby preventing an uneven image density from being produced.

Another object of the present invention relates to a developing apparatus and an assembling method for this apparatus which uniformalize a pressure of a developing blade against a developer carrying body in a longitudinal direction.

Still another object of the present invention relates to a developing apparatus which is capable of reducing the number of parts and an assembling method for this apparatus.

Further objects and features of the present invention will be more apparent from the following detailed description made with reference to the accompanying drawings.

DETAILED DESCRIPTION OF THE PREFERRED EMBODIMENTS

Now, embodiments of the present invention will be described with reference to the accompanying drawings.

In the description that follows, a longitudinal direction is a direction which is perpendicular to a conveying direction which is perpendicular to a conveying direction of a recording medium and in parallel with a surface of the recording medium.

<First embodiment>

Figure 1:
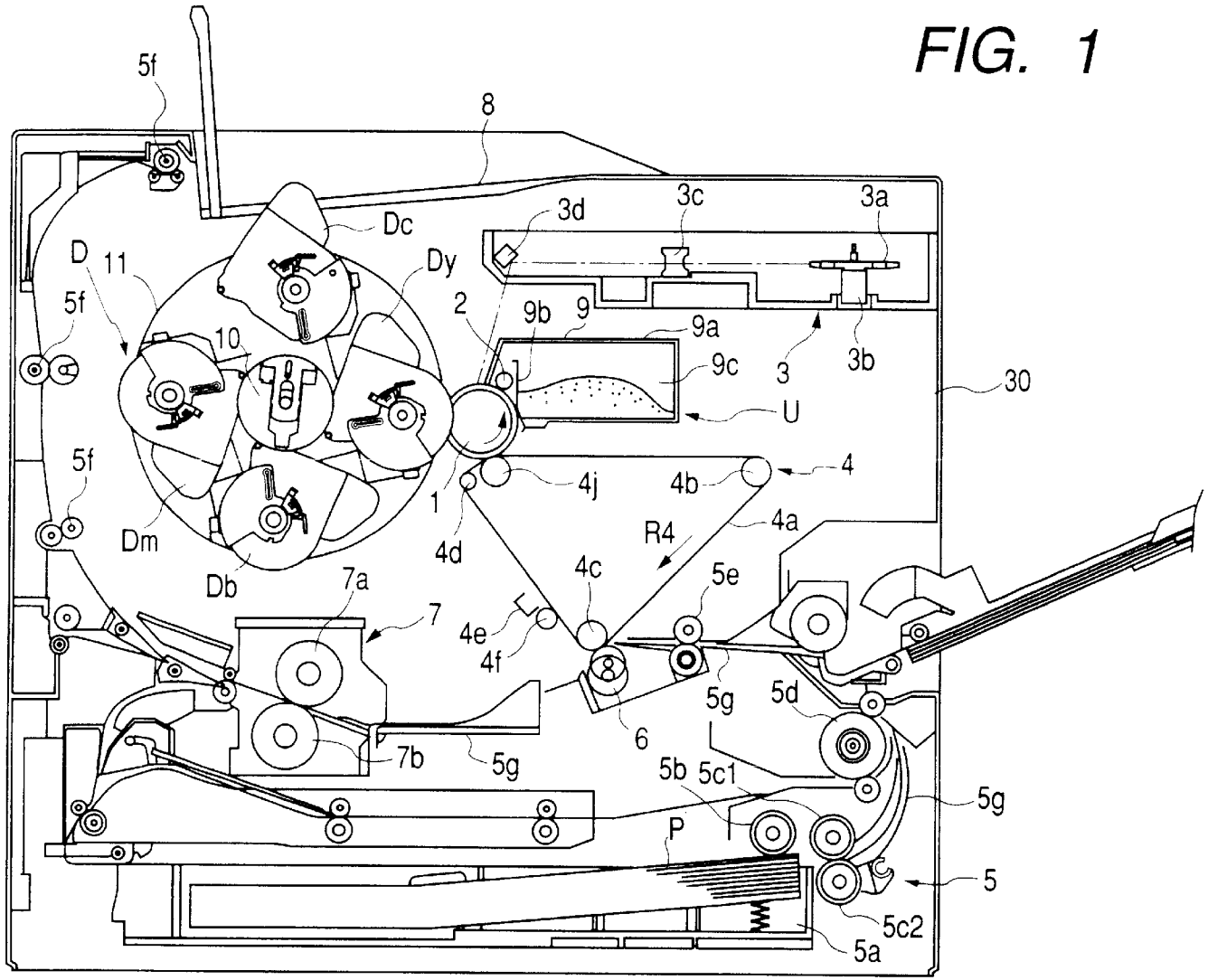
FIG. 1 is a longitudinal sectional view of an image forming apparatus according to the present invention.
Figure 2:
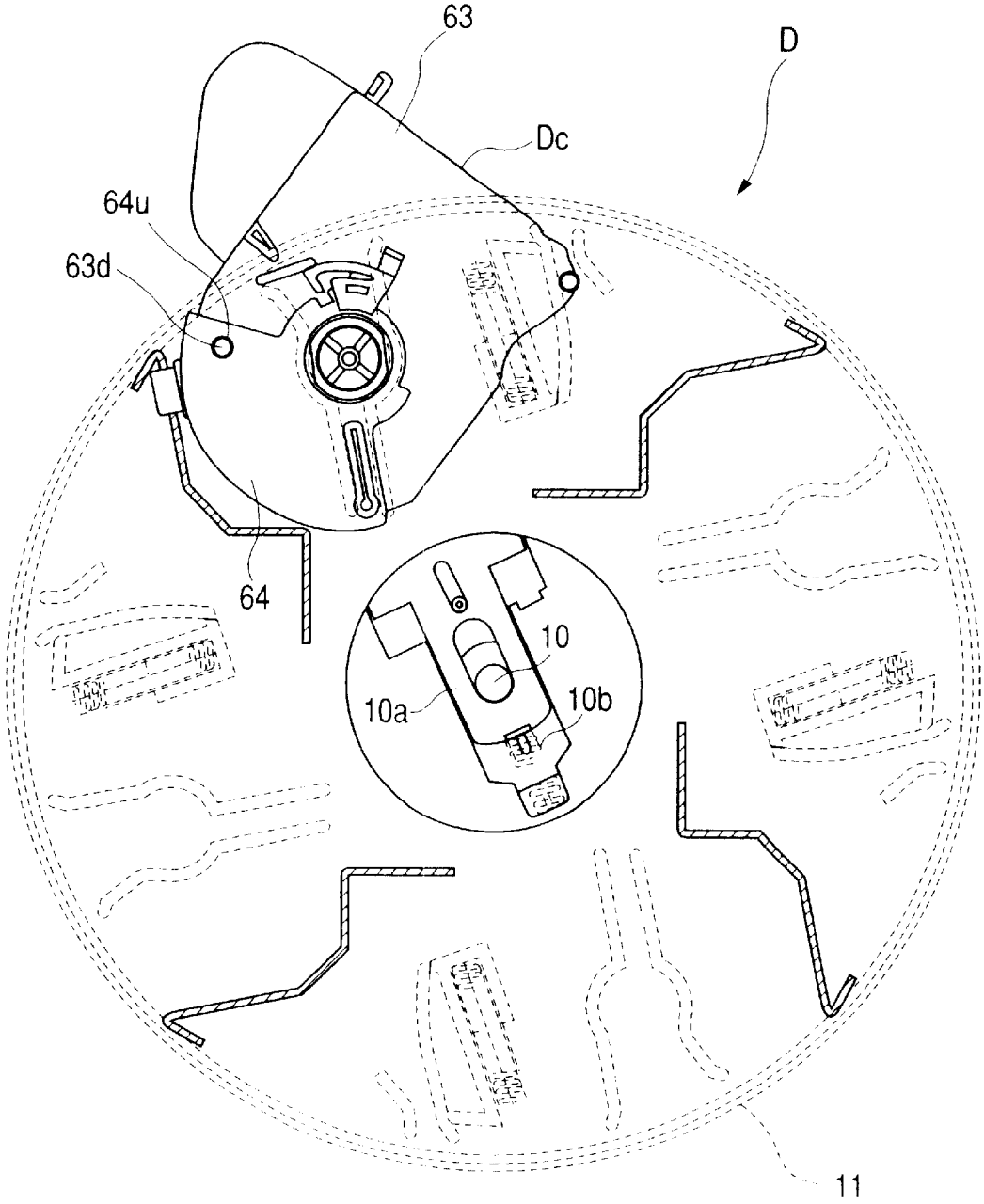
FIG. 2 is a sectional view taken perpendicularly to a shaft of a rotary unit.
Figure 3:
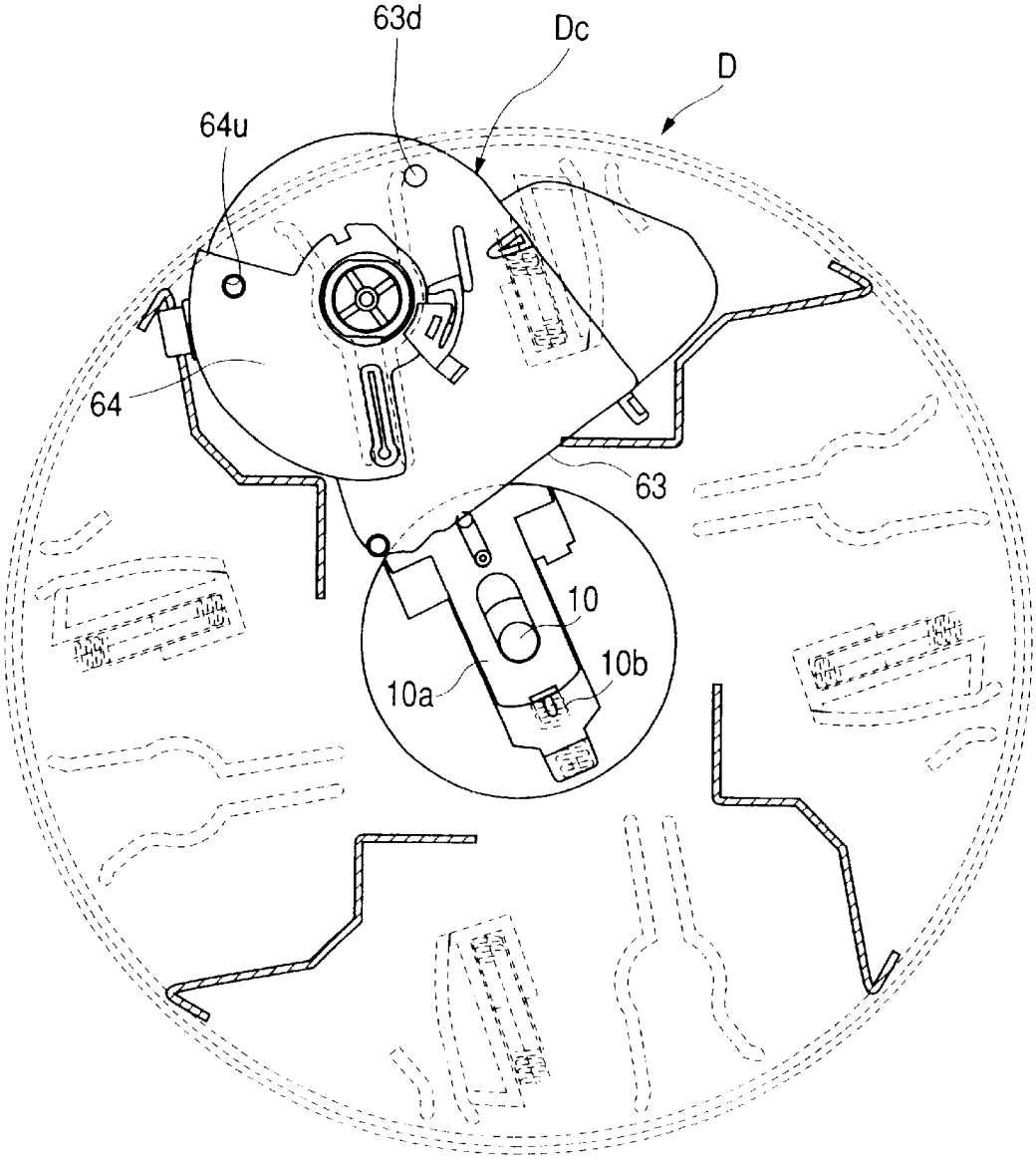
FIG. 3 is a sectional view taken perpendicularly to the shaft of the rotary shaft.
Figure 4:
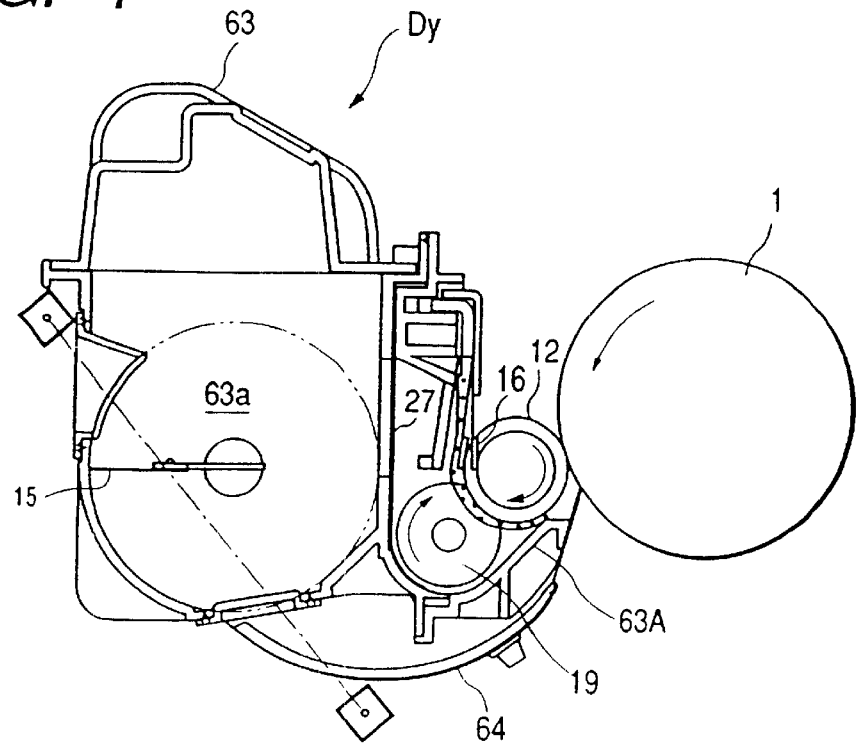
FIG. 4 is a longitudinal sectional view of a color developing cartridge.
Figure 5:
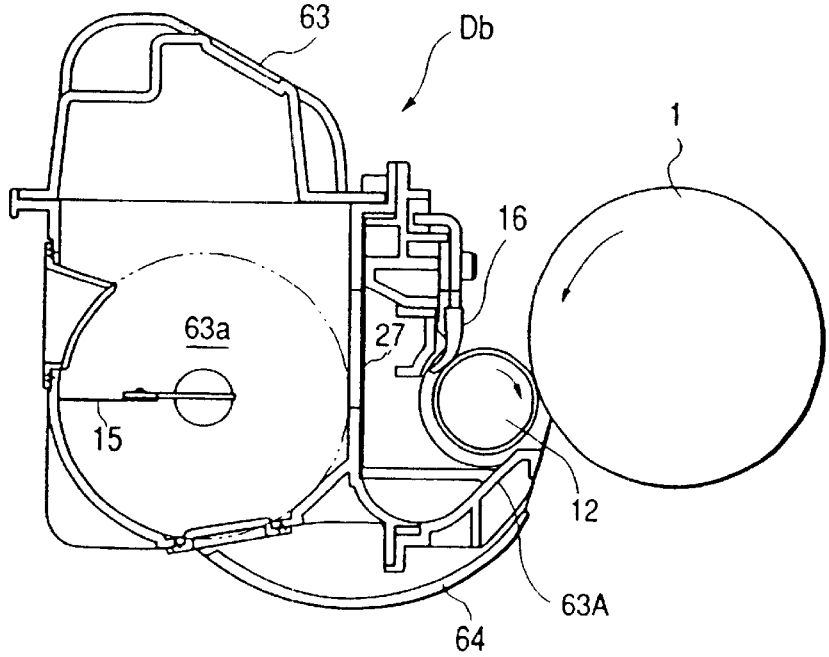
FIG. 5 is a longitudinal sectional view of a black developing cartridge.

FIG. 1 is a longitudinal sectional view of an image forming apparatus according to the present invention, FIGS. 2 and 3 are sectional views taken perpendicularly to a shaft of a rotary unit, and FIGS. 4 and 5 are longitudinal sectional views of a developing cartridge.

(Image Forming Apparatus)

First, description will be made of an outline of a configuration of the image forming apparatus according to the present invention.

The image forming apparatus shown in FIG. 1 is a laser beam printer which forms a color image by electrophotography in which a surface of a photosensitive drum 1 which is a drum like image bearing body (electrophotographic photosensitive body) rotating at a constant speed is uniformly charged by charging means 2. By irradiating this photosensitive drum 1 with a laser beam corresponding to image information which is emitted from exposure means 3, an electrostatic latent image is formed on the above described photosensitive drum 1, which is developed and visualized as a developed image with four developing cartridges D (Dm, Dc, Dy and Db).

The developed image formed on the photosensitive drum 1 is transferred and overlapped consecutively on a belt-like intermediate transferring unit 4 to form a color image, which is transferred by transferring means 6 to a recording medium (for example, recording sheet or OHP sheet) P which is conveyed by conveying means 5 from a feeding section. The recording medium P to which the color image is transferred is conveyed to fixing means 7 for fixing he color image and then discharged into a discharge section 8 on a top surface of the apparatus.

Then, description will be made specifically of a configuration of each of the above described members.

First, the photosensitive drum 1 is configured integrally with a container-like frame body 9*a* of cleaning means 9. The cleaning means 9 functions to remove a toner which remains on the photosensitive drum 1 after the developed image (toner image) is transferred to the intermediate transferring unit 4.

A process cartridge U is detachably attached to a main body 30 of the image forming apparatus and exchangeable by a user dependent on a service life of the photosensitive drum 1.

The photosensitive drum 1 is composed by coating an outside surface of an aluminum cylinder having an outside diameter of approximately 50 mm with an organic photoconductive material and rotatably supported by the container like frame body 9*a* of the cleaning means 9 which serves also as a holder for the above described photosensitive drum 1 are a cleaning blade 9*b* which scratches and removes the residual toner from the above-described photosensitive drum 1 and charging means 2.

Accordingly, the photosensitive drum 1, the cleaning means 9 and the charging means 2 are integrated with one another so as to compose the process cartridge U which is detachably attachable to the main body 30 of the apparatus.

Figure 13:
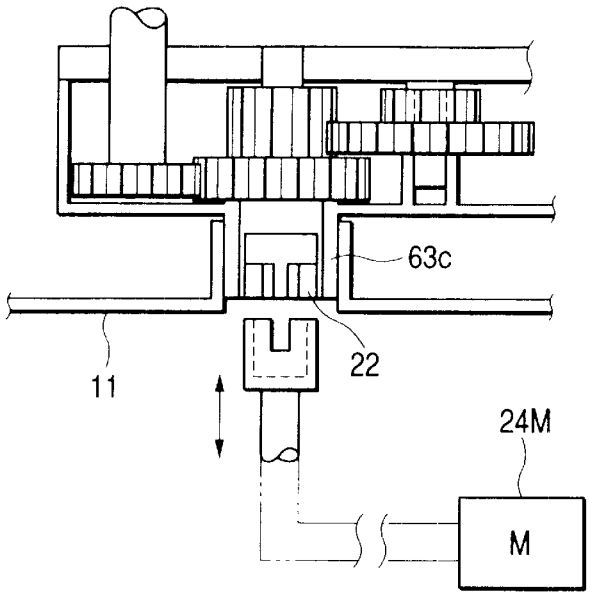
FIG. 13 is a partial plan view showing a configuration of a driving system for the developing cartridge.

The photosensitive drum 1 rotates in a direction indicated by an arrow (counterclockwise) in FIG. 1 dependently on image forming operations while receiving a driving force from a driving motor 24M (see FIG. 13).

The charging means 2 uses the so-called contact charging method and functions to uniformly charge a surface of the photosensitive drum 1 by applying a voltage to an electrically-conductive roller which rotates in contact with the surface of the photosensitive drum 1.

When an image signal is given to a laser diode (not shown) in the above-described exposure means 3 which exposes the photosensitive drum 1 charged by the charging means 2, the laser diode irradiates a polygon mirror 3*a* with an image beam corresponding to the image signal. The polygon mirror 3*a* is rotated at a high speed by a scanner motor 3*b* and the image beam which is reflected by the above-described polygon mirror 3*a* selectively exposes the surface of the photosensitive drum 1 by way of a lens 3*c* and a reflecting mirror 3*d* rotating at a constant speed, thereby forming an electrostatic latent image on the photosensitive drum 1.

The above-described electrostatic latent image is developed color by color with the above-described developing cartridges (developing apparatuses) D (Dm, Dc, Dy and Db). The configuration of the developing will be described later.

The toner image which is developed with the developing cartridges D is transferred to the intermediate transferring unit 4 serving as a second image bearing body which performs secondary transferring of a plurality of toner images consecutively transferred primarily from the photosensitive drum 1 and overlapped collectively to the recording medium P and has an intermediate transferring belt 4*a* running in a direction indicated by an arrow R4.

The above-described intermediate transferring belt 4*a* has a circumferential length of approximately 440 mm and is stretched over a driving roller 4*b*, a secondary transferring opposed roller 4*c* and a follower roller 4*d*. The image forming apparatus has a clamp roller 4*j* which is located at a position where the clamp roller 4*j* is brought close to the follower roller 4*d* and presses the intermediate transferring belt 4*a* to the photosensitive drum 1, and another position where the clamp roller 4*j* is retreated to allow the intermediate transferring belt 4*a* to be apart from the photosensitive drum 1.

The intermediate transferring belt 4*a* runs in the direction indicated by the arrow R4 as the driving roller 4*b* rotates and disposed at a predetermined location outside the above-described intermediate transferring belt 4*a* is a cleaning unit 4*e* which can be brought into contact and separated into and from a surface of the above-described intermediate transferring belt 4*a* so that the toner remaining after the collective secondary transferring of the toner images to the recording medium P is removed with the cleaning unit 4*e*. Electric charges reverse to those at a toner transferring time are imparted to the toner by bringing a charging roller 4*f* into contact with the intermediate transferring belt 4*a* with the cleaning unit 4*e*, and the toner to which the reverse electric charges are imparted is electrostatically adhered to the photosensitive drum 1 and then recovered by the cleaning means 9 for the photosensitive drum 1. A cleaning method for the intermediate transferring belt 4*a* is not limited to the above-described electrostatic cleaning and it is possible to adopt a mechanical method using a blade, a fur brush or the like, a method using a combination of the electrostatic cleaning and mechanical method, and the like.

The cleaning means 9 which removes the toner remaining on the surface of the photosensitive drum 1 after the toner image is transferred to the intermediate transferring unit 4 scrapes off residual toner with the cleaning blade 9*b* which is brought into contact with the surface of the photosensitive drum 1 and accumulates the residual toner into a waste toner container 9*c*. This waste toner container 9*c* is composed of the container-like frame body or cleaning frame body 9*a*, an amount of the waste toner stored in the waste toner container or a volume of the waste toner container 9*c* is set so that the container will not be completely filled with the waste toner before the service life of the photosensitive drum 1 expires and disposal of the waste toner in the waste toner container 9*c* can be performed together with exchange of the process cartridge U when the service life of the photosensitive drum 1 is expired.

The above-described transferring means 6 which transfers the toner images multiply transferred to the intermediate transferring unit 4 to the recording medium P is composed of a transferring roller 6 is composed by winding an expanded elastic material having medium resistance around a metal shaft and disposed movably in an up-down direction in FIG. 1.

While the toner images of four colors are being formed on the above-described intermediate transferring unit 4 (that is, while the intermediate transferring unit 4 makes a plurality of rotations), this transferring roller 6 is located downward and kept apart form the intermediate transferring unit 4 as indicated by a solid line in FIG. 1 so as not to disturb the images. After the toner images are multiply transferred to the intermediate transferring unit 4 and formation of the color image is completed, the transferring roller 6 is moved by a cam (not shown) to an upward location as indicated by a chain line in FIG. 1 at a timing to transfer the color image to the recording medium P. Accordingly, the transferring roller 6 is pressed to the intermediate transferring unit 4 under a predetermined pressure by way of the recording medium P. Simultaneously, a bias voltage is applied to the transferring roller 6, whereby the toner images are transferred from the intermediate transferring unit 4 to the recording medium P.

The above-described conveying means 5 which conveys the above-described recording medium P is composed of a sheet feeding cassette 5*a* containing a plurality of recording media P, a pickup roller 5*b*, a feeding roller 5*c*1, a double feeding preventing retard roller 5*c*2, a conveying roller pair 5*d*, a registration roller pair 5*e*, discharge roller pairs 5*f* and a conveyance guides 5*g* as shown in FIG. 1.

At an image formation time, the pickup roller 5*b* is rotatingly driven in correspondence to an image forming operation, thereby separating and feeding the recording media P in the sheet feeding cassette 5*a* one by one. The recording medium P sent out of the sheet feeding cassette 5*a* attains to the registration roller pair 5*e* by way of the conveying roller pair 5*d* while being guided by the conveyance guide 5*g*. The registration roller pair 5*e* performs a nonrotating operation for setting the recording medium P in a stationary standby condition and a rotating operation for conveying the recording medium P to the intermediate transferring unit 4 in a predetermined sequence during the image forming operation as well as positioning between the image and the recording medium P is performed at a next transferring step, and the color image is transferred to the recording medium P by the above-described transferring means 6.

The recording medium P to which the color image is transferred is conveyed to the fixing means 7 for fixing the toner image. The fixing means 7 is composed of a fixing roller 7*a* for applying heat to the recording medium P and a pressurizing roller 7*b* for bringing the recording medium P into pressure contact with the fixing roller 7*a*: both the rollers 7*a* and 7*b* being hollow rollers which comprise heaters and to be rotatingly driven respectively.

The toner images are fixed to the recording medium P by conveying the recording medium P while applying heat and a pressure to the recording medium P and the recording medium P on which the toner is fixed is discharged into the discharge section 8 by a discharge roller pair 5*f* composing the conveying means 5.

(Developing cartridge (developing apparatus))

Now, a description will be made of the developing cartridge D for developing electrostatic latent images formed on the photosensitive drum 1.

The image forming apparatus according to the embodiment has four developing cartridges D (Dm, Dc, Dy and Db) which are capable of developing colors of magenta, cyan, yellow and black for forming a full-color image.

The developing cartridges D are detachably attached to a rotary unit 11 rotating around a center shaft 10 as shown in FIGS. 1 through 3. For forming an image, the cartridges D are rotatingly moved around the center shaft 10 in a condition where the cartridges are held on the rotary unit 11 and a developing cartridge D containing a predetermined color toner is stopped at a position opposed to the photosensitive drum 1. Then, the developing roller 12 functioning as the developer bearing body (see FIG. 4) is positioned so as to be opposed to the photosensitive drum 1 with a slight gap (on the order of approximately 300 $\mu$m) reserved and the toner is supplied in correspondence to the electrostatic latent image on the photosensitive drum 1, whereby the electrostatic latent image on the photosensitive drum 1 is developed.

For forming a color image, the rotary unit 11 rotates each time the intermediate transferring unit 4 makes a rotation to carry out a developing step in a sequence of a magenta developing cartridge Dm containing a magenta color toner, a cyan developing cartridge Dc containing a cyan color toner, a yellow developing cartridge Dy containing a yellow color toner and a black developing cartridge containing a black color toner. In addition, the black color toner is a magnetic toner, whereas the other color toners are nonmagnetic toners.

FIG. 4 shows a condition where the cartridge D (for example, the yellow developing cartridge Dy) is positioned and stationary at a developing position opposed to the photosensitive drum 1. This developing cartridge D (Dy) has a developing roller 12 functioning as a toner carrier which supplies the toner to the photosensitive drum 1, a toner accommodating section 63*a* which accommodates the toner to the above-described developing roller 12, a cartridge frame 63 which is composed by coupling a plurality of frames for supporting the developing roller 12 and a shutter 64 which opens and closes an opening for exposing the developing roller 12. In addition, disposed in the above-described toner accommodating section 63*a* is a toner feeding member 15.

By the way, attached to a new developing cartridge D is a toner seal 27 to prevent the toner from leaking out of the above-described toner accommodating section 63*a*. The toner can therefore be supplied from the toner accommodating section 63*a* to the developing roller 12 when a user unseals the toner accommodating section 63*a* by peeling off the above-described toner seal 27 prior to mounting of the new developing cartridge D on the main body 30 of image forming apparatus.

When the above described toner feeding member 15 is rotated with a driving force obtained from the main body 30 of the image forming apparatus, the toner is fed from the toner accommodating section 63*a* to the developing roller 12. The developing roller 12 is an aluminum roller which is rotatably supported and a developing blade 16 functioning as a developer regulating member is in pressure contact with a circumferential surface of the developing roller 12. Accordingly, the toner is coated as a thin layer on the circumferential surface and electric charges are imparted to the toner (frictional charge) when the developing roller 12 rotates in a direction indicated by an arrow (clockwise direction) in FIG. 4.

A developing bias voltage supplied from the main body 30 of the image forming apparatus is applied to the developing roller 12 which is opposed to the photosensitive drum 1 on which the electrostatic image is formed, whereby a toner image is formed on the photosensitive drum 1 in correspondence to the electrostatic image.

The magenta developing cartridge Dm, the cyan developing cartridge Dc, the yellow developing cartridge Dy and the black developing cartridge Db have the same configuration and the same function. The developing roller 12 of each developing cartridge D is connected to a color developing high voltage power supply and a driving source disposed in the main body 30 of the image forming apparatus when the developing cartridge D is moved to the developing position, and the developing bias voltage is applied and a driving force is transmitted consecutively and selectively to the developing cartridges D for rotatingly driving the developing rollers 12 and the like.

Furthermore, each developing cartridge D has a coating roller 19 which is rotatably disposed in the cartridge frame 63 and has a circumferential surface rotating in a direction reverse to a rotating direction of the circumferential surface of the developing roller 12.

A black developing cartridge Db shown in FIG. 5 has a coating roller (not shown). The toner adheres to the developing roller 12 owing to a magnetic force of a magnet (not shown) built in the developing roller 12 and an adhesive force, and the developing blade 16 which is in contact with the circumferential surface of the developing roller 12 regulates a thickness of a toner layer and imparts triboelectric charges to the toner.

Figure 6:
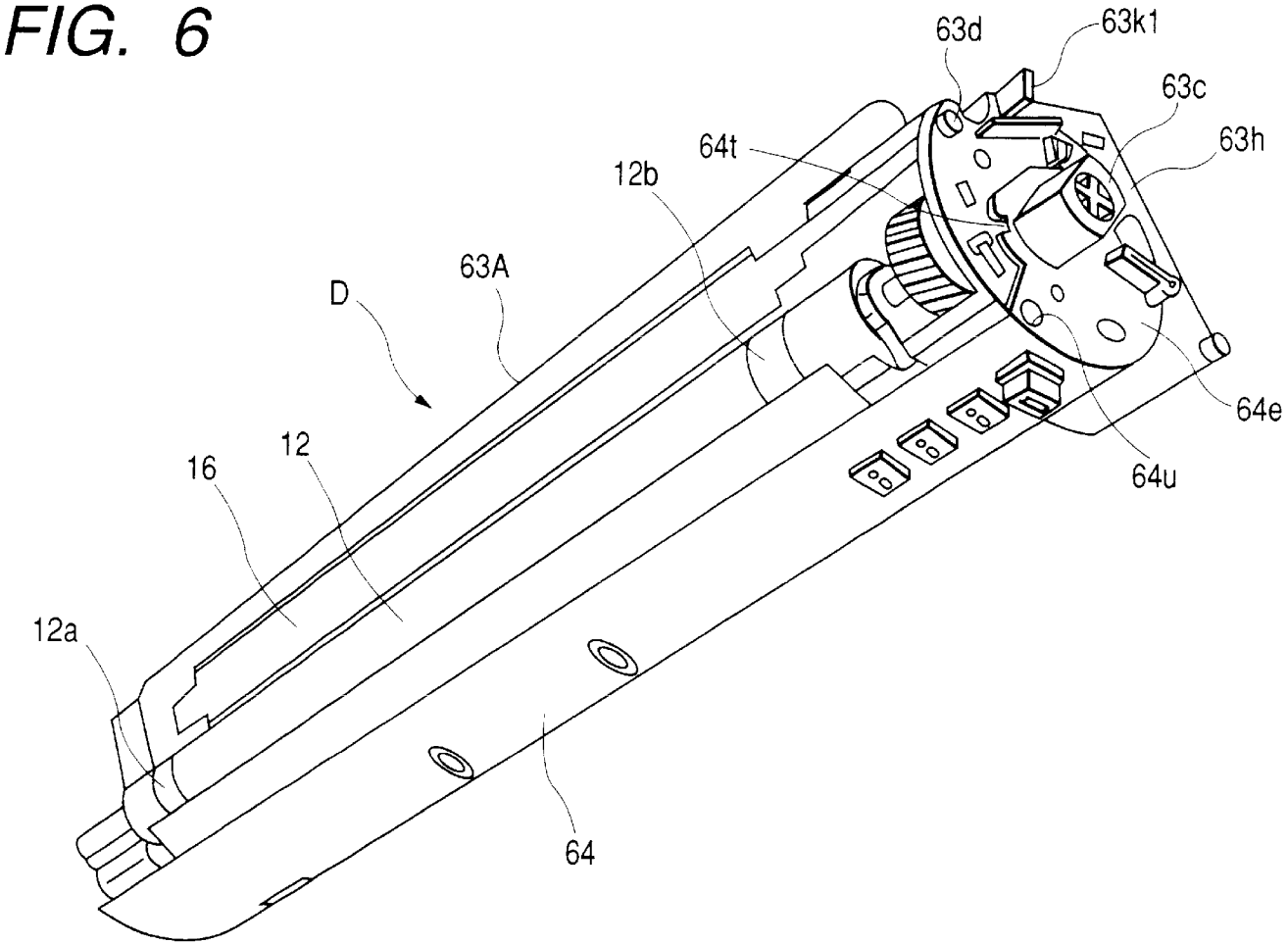
FIG. 6 is a perspective view of a developing cartridge in a condition where a shutter is open.
Figure 7:
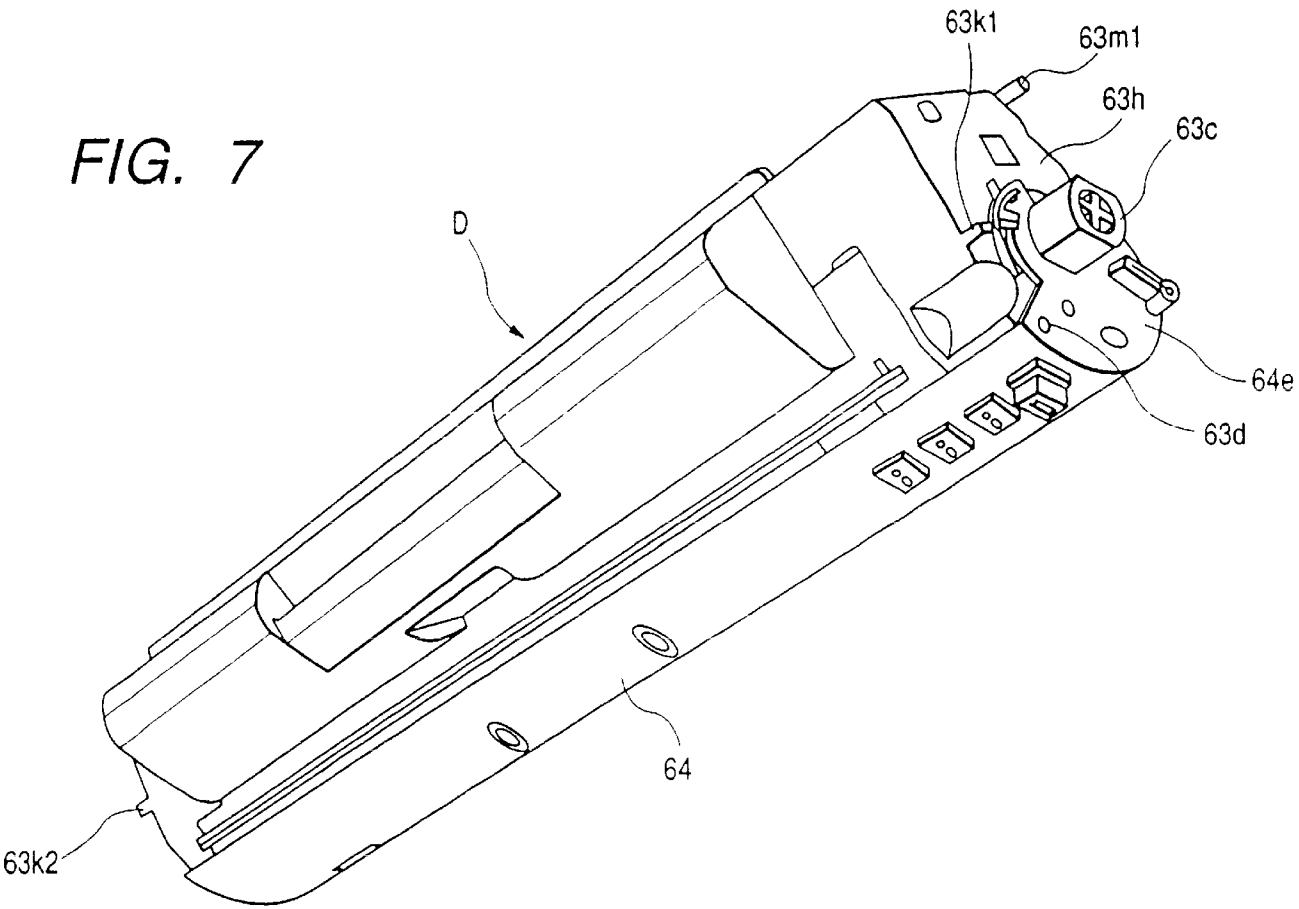
FIG. 7 is a perspective view of the developing cartridge in a condition where the shutter is closed.
Figure 9:
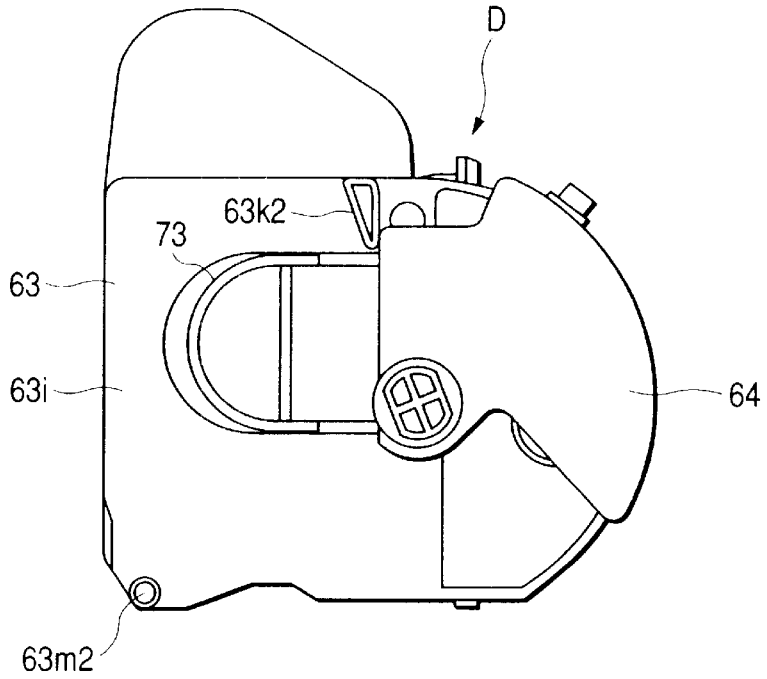
FIG. 9 is a side view of an anti-driven side of the developing cartridge in the condition where the shutter is closed.
Figure 10:
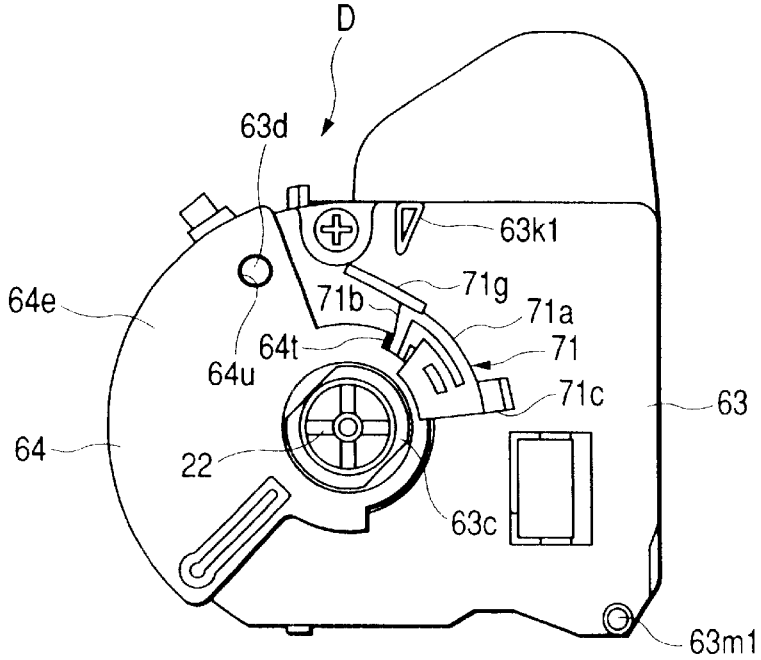
FIG. 10 is a side view of the driven side of the developing cartridge in the condition where the shutter is closed.
Figure 11:
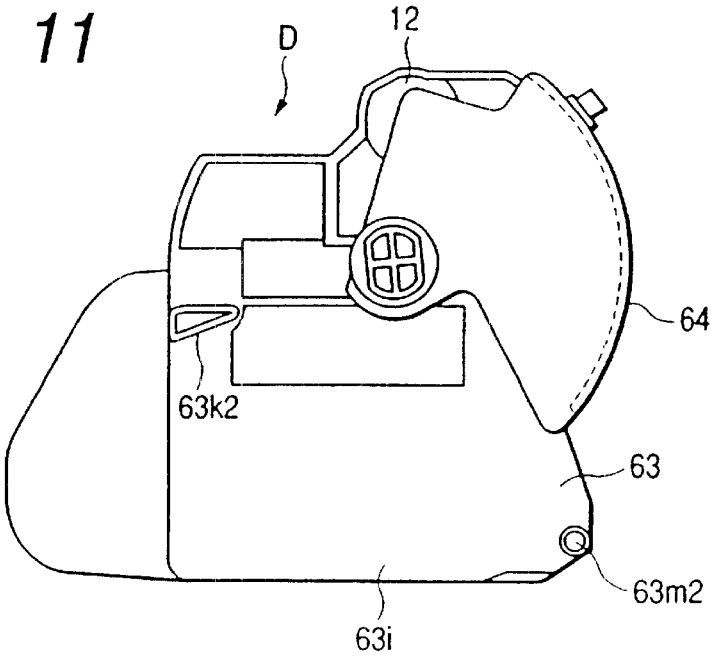
FIG. 11 is a side view of the nondriven side of the developing cartridge in the condition where the shutter is open.
Figure 12:
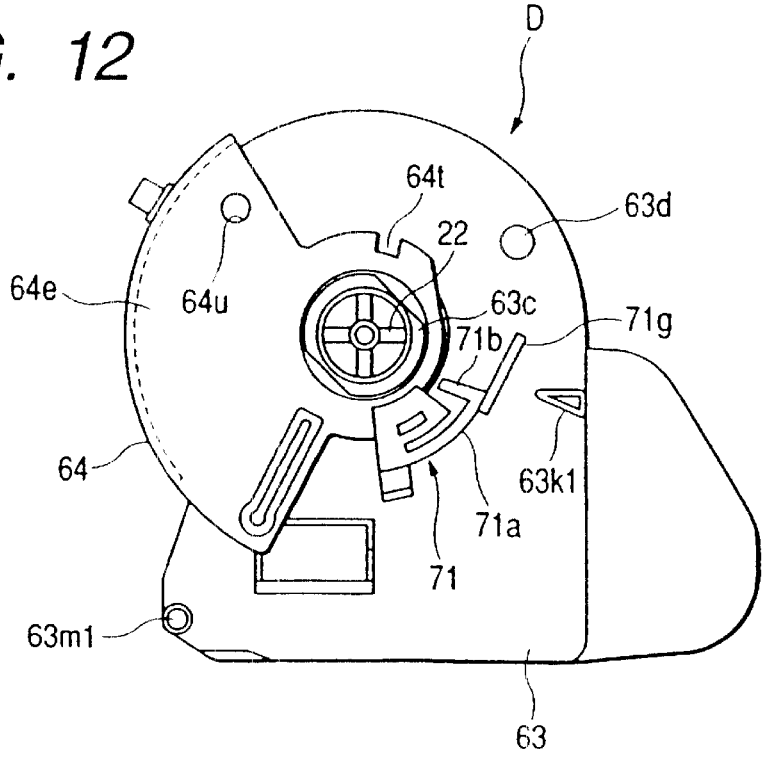
FIG. 12 is a side view of the driven side of the developing cartridge in the condition where the shutter is open.

A configuration of the developing cartridge D will be described here in detail with reference to FIG. 6 through 12. FIGS. 6 and 7 are perspective views of the developing cartridge, FIG. 8 is an exploded perspective view of the developing cartridge, FIGS. 9 and 10 are side views of the developing cartridge in a condition where a shutter is closed, and FIGS. 11 and 12 are side views of the developing cartridge in a condition where the shutter is open.

Figure 8:
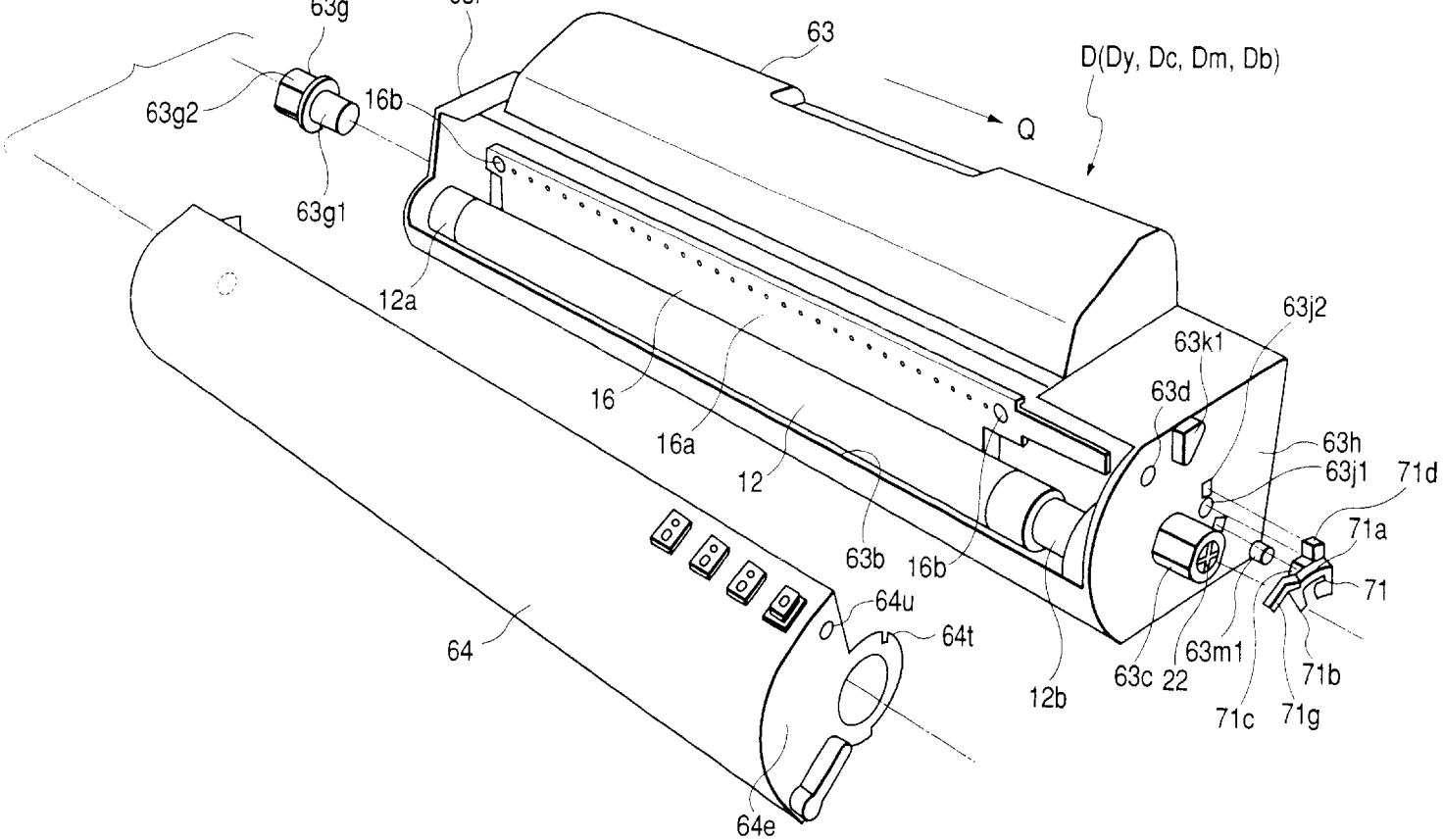
FIG. 8 is an exploded perspective view of the developing cartridge.

An opening 63*b* is formed in the cartridge frame 63 of the developing cartridge D in a longitudinal direction as shown in FIG. 8 and the developing roller 12 is supported by the cartridge frame 63 so as to be exposed from the opening 63*b*. A cylindrical protrusion 63*c* is formed integrally with the cartridge frame 63 nearly at a center of a side surface in the longitudinal direction of the cartridge frame 63. The protrusion 63*c* serves as a guide for inserting the developing cartridge D into the main body 30 of the image forming apparatus and a rotational center for attaching and detaching the developing cartridge D to and from the main body 30 of the image forming apparatus.

Furthermore, a protrusion 63*g* is detachably attached nearly at a center of the other side surface 63*i* in the longitudinal direction of the cartridge frame 63. The protrusion 63*g* is shown in a detached condition in FIG. 8. The protrusion 63*g* is attached to the cartridge frame 63 by inserting an inserting portion 63*g*1 into a hole (not shown) formed in the side surface 63i. An inverted pawl like portion (not shown) is formed on a tip of the inserting portion 63*g*1 so that the protrusion 63*g* is attached to the cartridge frame 63 by the inverted pawl like portion which is engaged with the cartridge frame. When the developing cartridge D is mounted at a mounting position of the rotary unit 11, a tip surface 63*g*2 of the protrusion 63*g* is pushed by a pushing member (not shown) protruded by an elastic force from an inside wall surface of the rotary unit 11. Accordingly, the developing cartridge D is pushed toward the side surface 63*h* (in a direction indicated by an arrow Q in FIG. 8). The developing cartridge D is therefore attached to the rotary unit 11 (main unit 30 of the image forming apparatus) taking as standard the side surface 63*h* on which a driving force receiving member 22 is disposed.

Figure 14:
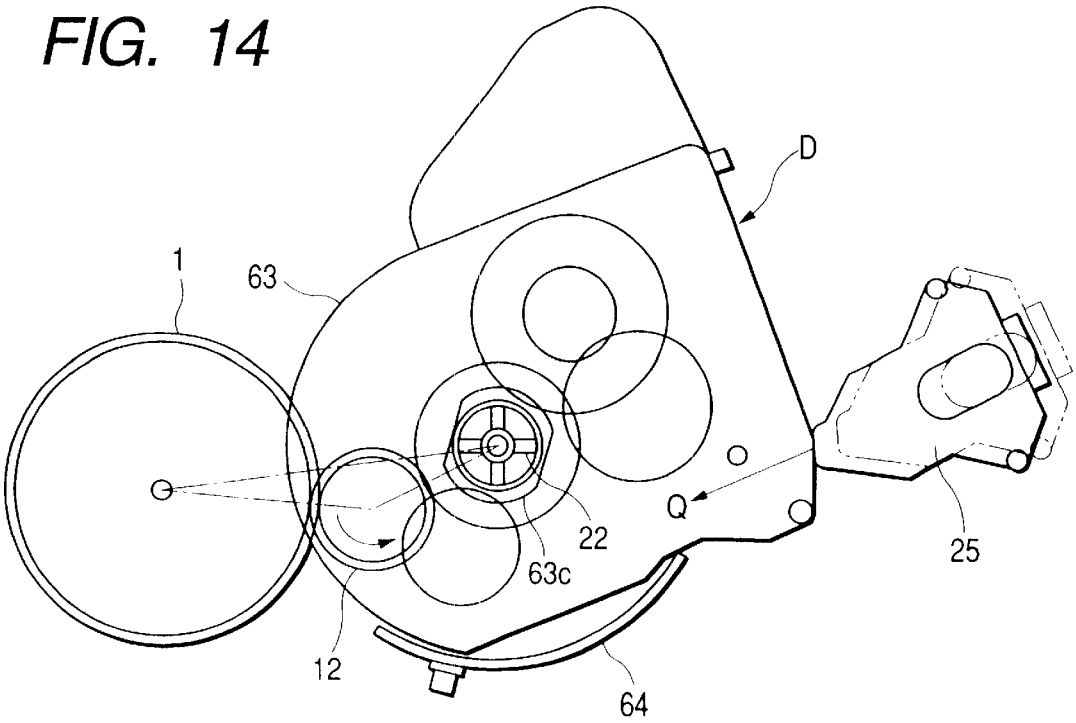
FIG. 14 is a side view showing the configuration of the driving system for the developing cartridge.

Furthermore, fitted over both ends of the developing roller 12 are spacer rollers 12*a* and 12*b* which have a radius larger than that of the above described developing roller 12 by a distance corresponding to a developing gap. Accordingly, a predetermined gap is reserved between the developing roller 12 and the photosensitive drum 1 at the developing position by pressing the spacer rollers 12*a* and 12*b* to the circumferential surface of the photosensitive drum 1 with an urging force of urging means 25 (see FIG. 14) or a compression coil spring 10*b* (see FIGS. 2 and 3) which urges a slide member 10*a*.

The above-described developing blade 16 has an elastic blade 102 and is attached to the cartridge frame 63 by screwing a plurality of machine screws 16*b* to a metal blade plate 16*a*, a supporting member. A configuration of the developing blade 16 will be described in detail later.

Furthermore, attached to the side surface 63*h* of the developing cartridge D is a lock member 71 (shown in a detached condition in FIG. 8). This lock member 71 has a lock engaging portion 71*b* which is to be engaged with a shutter engaging concave portion 64*t* formed in a side wall 64*e* of a shutter 64, a supporting portion 71*a* for supporting the above-described lock engaging portion 71*b*, and attaching portions 71*c* and 71*d* which are to be engaged with holes 63*j*1 and 63*j*2 formed in the side surface 63*h* of the cartridge frame 63. The lock member 71 is a monolithically molded plastic member, an arm portion 71*g* of the above described lock member 71 comes into contact with a fixed portion disposed in the main body 30 of the image forming apparatus at a process to mount at the mounting position, the above-described supporting portion 71*a* is deflected and the above-described engaging portion 71*b* is disengaged from the shutter engaging concave portion 64*t*, thereby unlocking the shutter 64.

A protrusion 63*d* which has a semispherical fitting portion is formed only on the side surface 63*h* in the longitudinal direction of the developing cartridge frame 63 as shown in FIGS. 3, 6 through 8, 10 and 12. As a fitting portion for the above-described protrusion 63*d*, a hole 64*u* is formed in the shutter 64 at a location corresponding to the protrusion 63*d*. Since the protrusion 63*d* is fitted in the hole 64*u* in the condition where the shutter 64 is closed, the developing cartridge frame 63 does not rotate to a position unstable relative to the shutter 64 even when the shutter 64 is unlocked by the lock member 71 as above-described.

Furthermore, positioning bosses 63*m* (63*m*1 and 63*m*2) and spring bearings 63*k* (63*k*1 and 63*k*2) protrude from the side surface 63*h* and the other side surface 63*i* of the cartridge frame 63 as shown in FIGS. 9 and 10.

In addition, reference numeral 73 in FIG. 9 denotes a toner seal pulling grip which is used for pulling out the above-described toner seal 27.

(Configuration of Developing Blade of Developing Cartridge)

On the basis of FIG. 15, description will be made of a configuration of the developing blades 16 of the yellow, cyan and magenta developing cartridges Dy, Dc and Dm except the black developing cartridge Db.

Figure 15:
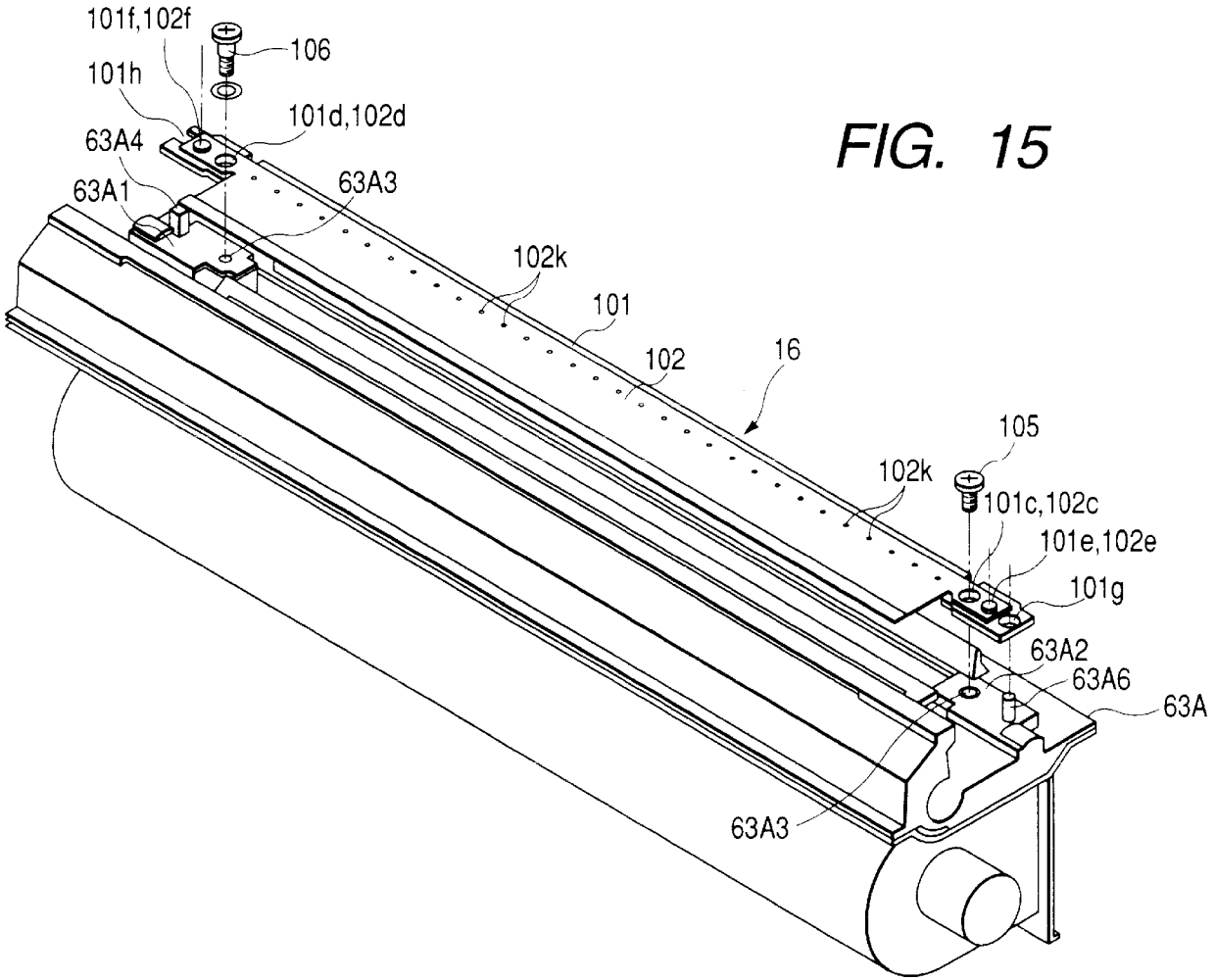
FIG. 15 is an exploded perspective view showing a configuration of the developing blade.

The developing blade 16 consists of two layers as shown in FIG. 15. That is, the developing blade 16 consists of a supporting plate 101 and an elastic blade 102 from a side of developing member supporting frame 63A.

Furthermore, round holes 102*e* and 102*f* for fitting the round dowels 101*e* and 101*f* are formed at the same locations respectively outside the above-described holes 101*c*, 102*c* and 101*d*, 102*d* at both the ends of the supporting plate 101 and the elastic blade 102 of the developing blade 16.

Positioning bearing surfaces 63A1 and 63A2 for mounting the developing blade 16 are disposed at both ends in the longitudinal direction of the developing member supporting frame 63A, and holes 63A3 for fixing the developing blade 16 to the developing member supporting frame 63A are formed in these bearing surfaces 63A1 and 63A2 respectively. A rectangular dowel 63A4 having a rectangular sectional shape is studded outside the hole 63A3 in the bearing surface 63A1 at the end in the longitudinal direction and a round dowel 63A6 is studded outside the hole 63A3 in the bearing surface 63A2 at the other end in the longitudinal direction.

At ends of the supporting plate 101 and the elastic blade 102 of the supporting plate 101 and the elastic blade 102 which compose the developing blade 16, holes 101*c* and 102*c* for a machine screw 105 (holes for loosely fitting and passing the machine screw 105, applicable also to description that follows) are formed so as to correspond to the hole 63A3 in the bearing surface 63A2 of the developing member supporting frame 63A, and holes 101*d* and 102*d* for a machine screw 106 are formed at the other ends respectively so as to correspond to the hole 63A3 in the bearing surface 63A1.

Furthermore, formed at the other end of the supporting plate 101 is a hole 101*g* for fitting over the round dowel 63A6 formed on the bearing surface 63A2 of the developing member supporting frame 63A. Furthermore, formed at the end of the supporting member plate 101 is a rectangular slot 101*h* for fitting over the rectangular dowel 63A4 which is disposed on the bearing surface 63A1 of the developing member supporting frame 63A.

The developing blade 16 is attached to the developing member supporting frame 63A in the following sequence:

(1) The elastic blade 102 is preliminarily placed on the supporting plate 101 taking the round dowels 101*e* and 101*f* of the supporting plate 101 as standard (the round holes 102*c* and 102*d* correspond to the round dowels 101*e* and 101*f* of the supporting plate 101 of the elastic blade 102).

(2) The supporting plate 101 and the elastic blade 102 are coupled with each other by welding. In order to prevent the elastic blade 102 from being deformed by welding, it is preferable to adopt portion welding with a YAG laser. In this case, multiple portions 102*k* are welded on a straight line connecting the round hole 102*c* to the round hole 102*d* with a nugget diameter of 0.5 to 2 mm and at intervals of 3 to 30 mm. In this embodiment the elastic blade 102 has a length of 230 mm in the longitudinal direction and welded at 22 portions at intervals of 10 mm.

(3) The supporting plate 101 which is coupled with the above-described elastic blade 102 is placed on the positioning bearing surfaces 63A1 and 63A2 of the developing member supporting frame 63A taking the round boss 63A6 and the rectangular boss 63A4 as standard.

(4) The supporting plate 101 is tightened with the machine screws 105 and 106.

The supporting plate 101 is a metal plate having a thickness on the order of 1 to 2 mm, and since rust produced on the supporting plate 101 causes improper development, the supporting plate 101 is made of stainless steel or plated with nickel or the like. Furthermore, the elastic blade 102 is thinner than the supporting plate 101 and is made of an elastic thin metal plate such as stainless steel having a thickness of 0.1 mm or phosphor bronze.

The embodiment in which the elastic blade 102 and the supporting plate 101 of the developing blade 16 are welded at least five or more portions having the nugget diameter of 0.5 to 2 mm is capable of preventing the developing blade 16 from being deformed in the longitudinal direction and uniformalizing a contact pressure of the above-described developing blade 16 to the developing roller 12, thereby preventing an uneven image density from being produced and allowing high quality images to be obtained stably. The intervals between adjacent welded portions of 3 to 30 mm in particular is effective for uniformalization of the above-described contact pressure.

The above-described YAG ($Y_3Al_5O_{12}$: $Nd^{3+}$) laser exhibits an efficiency higher than other lasers and is preferably used.

What is claimed is:

1. A developer apparatus comprising:

a developing frame having an opening;

a developer carrying body disposed in said opening and carrying a developer; and a regulating member for regulating a thickness of the developer carried by said developer carrying body, wherein said regulating member includes an elastic blade to be brought into contact with said developer carrying body and a supporting member for supporting said elastic blade, and said supporting member is supported by said developing frame, wherein a free end of said elastic blade, which is in contact with said developer carrying body, protrudes from an end portion of said supporting member, and wherein a side opposite to said free end, of said elastic blade is coupled with said supporting member by welding.

2. A developing apparatus according to claim 1, wherein said elastic blade is welded to said supporting member at a plurality of portions at intervals in a longitudinal direction of said elastic blade.

3. A developing apparatus according to claim 2, wherein said intervals of said plurality of portions are 3 to 30 mm.

4. A developing apparatus according to claim 2, wherein said plurality of portions are at least five.

5. A developing apparatus according to any one of claims 1 through 4, wherein the portion at which said elastic blade is welded to said supporting member has a nugget diameter of 0.5 to 2 mm.

6. A developing apparatus according to claim 1, wherein said elastic blade is coupled with said supporting member by YAG laser welding.

7. A developing apparatus according to claim 1, wherein said elastic blade has a thickness smaller than a thickness of said supporting member.

8. A developing apparatus according to claim 7, wherein said elastic blade has a thickness of 1 to 2 mm.

9. A developing apparatus according to claim 1, wherein said elastic blade includes a metal plate.

10. A developing apparatus according to claim 1, wherein said developing apparatus is detachably attachable to a main body of an image forming apparatus.

11. A developing apparatus according to claim 1, wherein said developing apparatus is disposed together with an image bearing body in a process cartridge detachably attachable to an image forming apparatus.

12. A method for assembling a developing member, including an elastic blade, in a developing apparatus, said method comprising the steps of:

overlapping the elastic blade for regulating a thickness of a developer carried by a developer carrying body with a supporting member so that a free end of an elastic blade, which is in contact with the developer carrying body, protrudes from an end portion of the supporting member;

coupling a side opposite to the free end of the elastic blade with the supporting member by welding; and attaching the supporting member to a developing frame.

13. A regulating blade for regulating a thickness of a developer carried by a developer carrying body, comprising:

an elastic blade in contact with the developer carrying body;

a supporting member for supporting said elastic blade;

wherein a free end of said elastic blade, which is in contact with the developer carrying body, protrudes from an end portion of said supporting member, and wherein a side opposite to said free end, of said elastic blade, is coupled with said supporting member by welding.

* * * * *

UNITED STATES PATENT AND TRADEMARK OFFICE

CERTIFICATE OF CORRECTION

PATENT NO. : 6,535,709 B2
DATED : March 18, 2003
INVENTOR(S) : Kanji Yokomori et al.

It is certified that error appears in the above-identified patent and that said Letters Patent is hereby corrected as shown below:

Column 3,
Line 29, "he" should read -- the --.

Column 9,
Lines 3 through 7, should be deleted.
Line 30, "63A1." should read
-- 63A1. Futhermore, round holes 102e and 102f for fitting the round dowels 101e and 101f are formed at the same locations respectively outside the above-described holes 101c, 102c and 101d, 102d at both the ends of the supporting plate 101 and the elastic blade 102 of the developing blade 16. --

Signed and Sealed this

Twenty-third Day of December, 2003

JAMES E. ROGAN
*Director of the United States Patent and Trademark Office*